US005301651A

United States Patent [19]

LaBorde et al.

[11] Patent Number: 5,301,651

[45] Date of Patent: Apr. 12, 1994

[54] THREE WAY WHEEL FOR COMPOUND ARCHERY BOW

[75] Inventors: Brian W. LaBorde; James R. Allshouse, both of Tucson, Ariz.

[73] Assignee: Paul E. Shepley, Jr., Tucson, Ariz.

[21] Appl. No.: 932,670

[22] Filed: Aug. 20, 1992

[51] Int. Cl.[5] ..... F41B 5/00

[52] U.S. Cl. ..... 124/25.6; 124/900; 124/23.1

[58] Field of Search ..... 124/25.6, 900

[56] References Cited

U.S. PATENT DOCUMENTS 4,078,538 3/1978 Shepley .
4,241,715 12/1980 Jennings .
4,338,910 7/1982 Darlington ..... 124/900
4,739,744 4/1988 Nurney .
4,838,236 6/1989 Kudlacek ..... 124/900
4,957,094 9/1990 Pickering et al. .
4,995,373 2/1991 Mussack ..... 124/900
5,020,507 6/1991 Larson ..... 124/900

*Primary Examiner*—Randolph A. Reese
*Assistant Examiner*—Anthony Knight
*Attorney, Agent, or Firm*—Cahill, Sutton & Thomas

[57] ABSTRACT

A three way post on each side of a wheel for a compound bow enables connections to a loop and a ferrule, and provides a clamp connection using a setscrew in a threaded hole in the post. The post is located along a line perpendicular to a diameter intersecting the axle upon which the wheel turns.

16 Claims, 3 Drawing Sheets

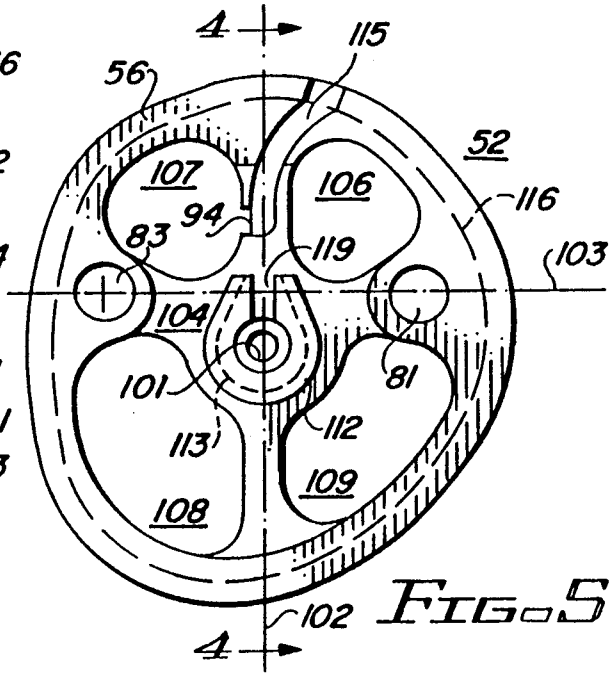
FIG. 5
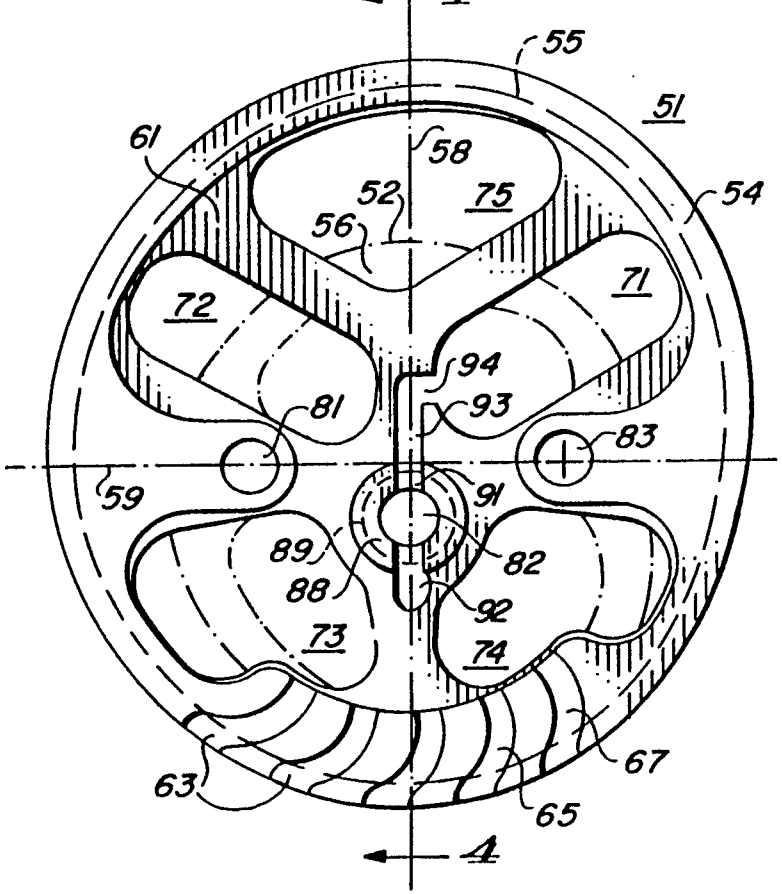
FIG. 4
FIG. 3

THREE WAY WHEEL FOR COMPOUND ARCHERY BOW

BACKGROUND OF THE INVENTION

This invention relates to compound archery bows and, in particular, to wheels capable of being laced at least three ways.

Compound bows differ from long bows in that a block and tackle mechanism is used to bend the bow: wheels are attached at the free ends of the limbs and lacing is wound around the wheels and attached to the limbs to obtain a mechanical advantage in bending the bow. The wheels and lacing differ from a block and tackle mechanism in that the wheels of a compound bow are eccentrically mounted on axles, causing a substantial "let off" or reduction in the holding force of a drawn bow, an effect more closely resembling that of levers rotating about the ends of the limbs of the bow.

As used herein, "wheel" refers to the entire rotating member at the end of a limb of a compound bow. The wheel is machined from metal, preferably aluminum or aluminum alloy, rigid plastic, or other rigid material. A wheel appears to be two adjoining disks having grooved rims, herein referred to as "pulleys," mounted on a common axle. In some compound bows, each wheel is actually two separate pulleys fastened together.

Compound bows typically use two wheels, with lacing wound from an anchor at one end of a one limb to the wheel at the end of the other limb, to the wheel at the end of the one limb, then back to an anchor on the other limb. As used herein, "lacing" can refer to a one piece bowstring or a three piece line comprising two end cables connected by a central stretch between the wheels which forms the bowstring. The lacing can be made from a variety of materials, i.e. the words "cable" and "string" imply location rather than material. A bowstring is typically a high strength man-made polymer fiber, such as high tensile strength polyester. The cables are either metal wires or polymer fibers.

For the manufacturer, there is a problem in how the lacing is attached to the wheels. Over the years, three basic techniques have developed for fastening the lacing to the wheels, each requiring a different wheel.

One type of lacing uses two metal cables, each terminating in what is known as a teardrop connector. The bowstring is shorter than the span between the wheels and has a closed loop formed at each end. The loops go over the teardrop connector at the free ends of each cable. Each cable extends from the teardrop connector and winds almost all of the way around the string pulley at the end of one limb, passes through the wheel to the cable side of the wheel and winds part way around the cable pulley, then extends to an anchor on the other limb. A setscrew in the wheel crimps the cable at some point to keep the cable from sliding around the pulley. A variation on this type of lacing uses no teardrop connectors and a one piece lacing.

A second type of lacing eliminates the teardrop connector and uses a bowstring which is longer than the span between the wheels. A closed loop is formed at each end of the bowstring. At one end, the loop engages a post in the interior of the wheel and the bowstring passes through an opening in the rim of the string pulley to wind almost all of the way around the string pulley, then across the span to similarly engage the other string pulley. The string pulley may have several openings spaced around its rim for changing the draw length of the bow, depending upon which opening is used. Each cable has a ferrule bonded to one end which fits in a socket in the interior of the cable side of the wheel. From the socket, the cable exits through an opening in the rim of the cable pulley, winds part way around the cable pulley, and extends to an anchor on the other limb.

In the third type of lacing, the bowstring is the same as in the second type of lacing. The cable is a polymer fiber, often the same material as the bowstring, and has a closed loop formed in one end instead of having a ferrule. The loop goes over a post on the cable side of the wheel and the cable exits through an opening in the rim of the cable pulley, winds part way around the cable pulley, and extends to an anchor on the other limb. For all three types of lacing, the bowstring and cable are wound on a wheel so that, as the bow is drawn, the bowstring unwinds and the cable winds further.

Each of the three types of lacing has its advantages and disadvantages, proponents and opponents. A wheel adapted to one type of lacing is typically incompatible with other types of lacing. One cannot arbitrarily add posts or sockets to the first type of wheel in order to adapt the wheel to other types of lacing since this may weaken the wheel, which must bear large forces especially when the bow is fired.

There are also three basic types of pulleys in terms of performance. Each pulley in a wheel can be either cam shaped or round. A cam shaped pulley produces a higher performance bow than a round pulley. By performance is meant the amount of energy stored in a drawn bow. In general, a higher performance bow is harder to draw, hence the greater energy stored, and requires more careful tuning, i.e. more careful adjustment of the bow to the size and style of the archer.

There are a large number of combinations of lacing and shapes for a wheel. When further combined with the variations in limb stiffness, handle geometry, arrow rest, and sight, the manufacturer is faced with an ever growing matrix of variables in order to accommodate the needs and preferences of its customers. The retailer is faced with a corresponding problem in stocking all the components and various pre-assembled bows from the manufacturer. While the variety benefits the customer, it is very costly for the manufacturer and retailer.

In the prior art, U.S. Pat. No. 4,078,538 discloses the first type of lacing but uses a mount clip instead of a setscrew for attaching the cable to the wheel. U.S. Pat. No. 4,241,715 discloses the first type of lacing and discloses anchoring the cable to the wheel rather than the limb. U.S. Pat. No. 4,739,744 discloses wheels having separate pulleys. U.S. Pat. No. 4,957,094 discloses the third type of lacing, i.e. both the cables and the bowstring attach to the wheel with loops.

In view of the foregoing, it is an object of the invention to provide a wheel for a compound bow which can accommodate all three types of lacing.

Another object of the invention is to provide three way connections on a wheel for a compound bow without weakening the wheel.

A further object of the invention is to provide a three way post connector for a wheel in a compound bow.

SUMMARY OF THE INVENTION

The invention achieves the foregoing objects by a post to which the lacing can be attached in three different ways. The post has a central hole providing a socket for a ferrule attached to the lacing. The outside diameter of the post exceeds the diameter of the hole by a predetermined, minimum amount to provide a thick wall around the hole and a large radius of curvature for a loop encircling the post. The wall includes slots on opposite sides of the hole and a portion of the hole is threaded. Lacing extending through the slots is held in place by a setscrew in the threaded portion of the hole.

Each pulley has a reduced thickness or recess for reducing the mass of the pulley and has a post located in the recess. The pulley also includes openings, for further reducing the mass of the pulley, located in quadrants defined by two perpendicular diameters of the pulley. A second hole, for receiving the axle upon which the pulley rotates, is located between the post and the rim along a first diameter of the pulley. Portions of the lacing lie along the second diameter of the pulley. In a wheel, the holes of one pulley are collinear with the corresponding holes of the other pulley.

BRIEF DESCRIPTION OF THE DRAWINGS

A more complete understanding of the invention can be obtained by considering the following detailed description in conjunction with the accompanying drawings, in which:

FIG. 3 illustrates the string side of a wheel constructed in accordance with a preferred embodiment of the invention.

FIG. 4 illustrates a cross-section along line 4—4 in FIG. 3.

FIG. 5 illustrates the cable side of a wheel constructed in accordance with a preferred embodiment of the invention.

DETAILED DESCRIPTION OF THE INVENTION

Figure 1:
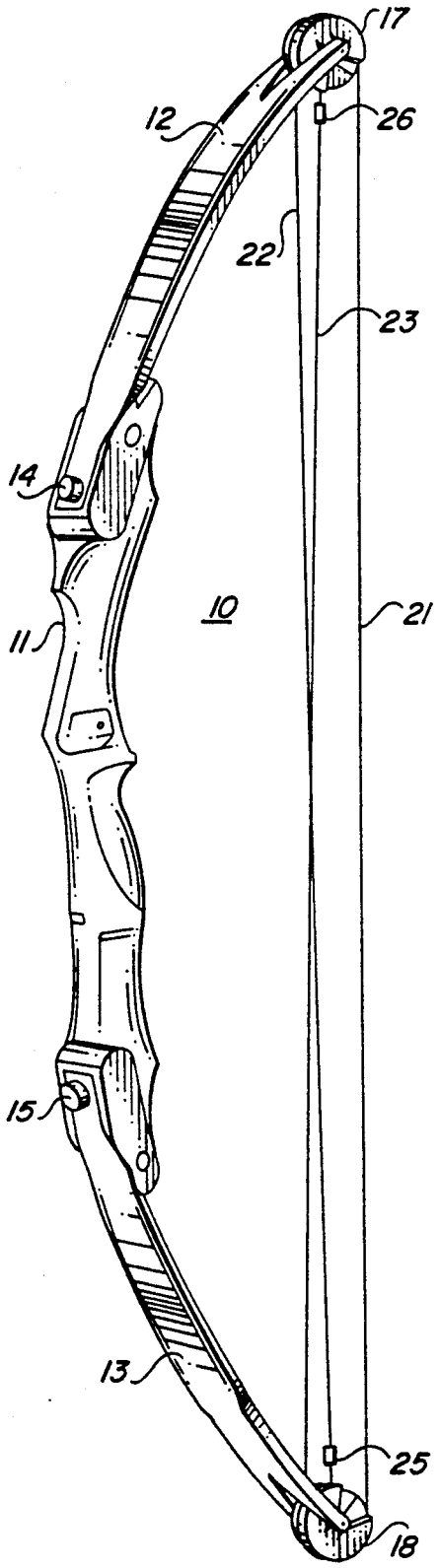
FIG. 1 illustrates the lacing on a compound archery bow having a pair of wheels.

In FIG. 1, compound bow 10 includes handle 11 attached to limbs 12 and 13 by bolts 14 and 15. Wheels 17 and 18 are mounted on axles attached to the free ends of limbs 12 and 13, respectively. The lacing includes bowstring 21 and cables 22 and 23 connected between wheels 17 and 18 and limbs 12 and 13. Specifically, bowstring 21 has one end connected to wheel 17 and the other end connected to wheel 18. The upper end of cable 22 is connected to wheel 17 and the lower end of cable 22 is connected to limb 13 by anchor 25. The upper end of cable 23 is connected to limb 12 by anchor 26. The lower end of cable 23 is connected to wheel 18. As bow 10 is drawn, bowstring 21 unwinds from wheels 17 and 18 while cables 22 and 23 wind further around wheels 17 and 18.

Figure 2A:
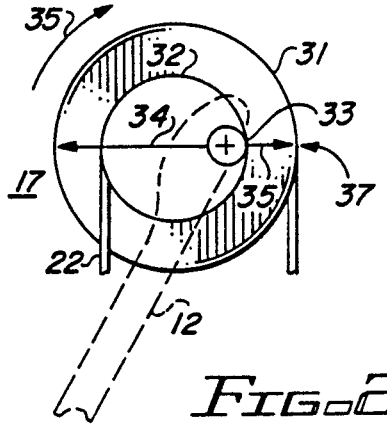
FIG. 2A illustrates the orientation of the upper wheel at the beginning of the draw.
Figure 2B:
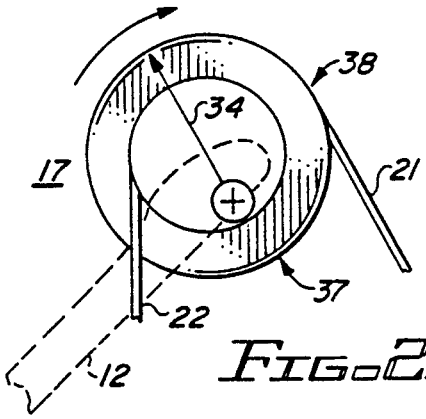
FIG. 2B illustrates the orientation of the upper wheel of a partially drawn bow.
Figure 2C:
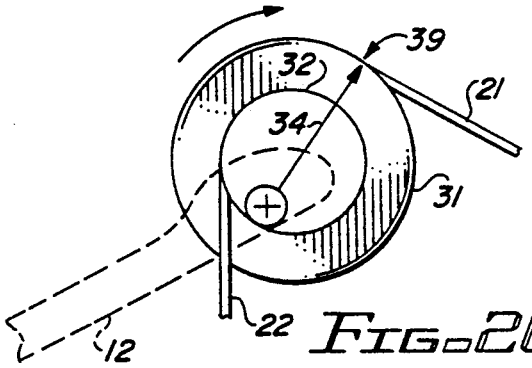
FIG. 2C illustrates the orientation of the upper wheel of a fully drawn bow.

FIGS. 2A-C diagrammatically illustrate the operation of wheel 17. String pulley 31 of wheel 17 is circular, as is cable pulley 32. As illustrated in FIGS. 2A-C, pulleys 31 and 32 are concentric and are eccentrically mounted on axle 33. Radii 34 and 35 are collinear, forming a diameter of pulley 31 intersecting the center of axle 33 and contact point 37. Contact point 37 is the point at which bowstring 21 first contacts pulley 31. Radius 34 is the longest radius of pulley 31 and points away from contact point 37 when the bow is at rest. As bowstring 21 is drawn to the right, the bowstring unwinds slightly and causes wheel 17 to rotate clockwise about axle 33, as shown by arrow 35, further unwinding bowstring 21. As wheel 17 rotates, cable 22 is wound further around pulley 32, drawing the ends of the limbs closer together. In FIG. 2B, the bow is partially drawn and limb 12 is flexed to the position shown. As bowstring 21 is drawn, radius 34 and the contact point, shown at position 38, move toward each other. In FIG. 2C, the bow is fully drawn and radius 34 intersects contact point 39. This corresponds to what is known as the "valley" or point of maximum let off, in the draw of a compound bow. Bowstring 21 is unwound as much as the bowstring should be and cable 22 is wound on pulley 32 as much as the cable should be. Any further draw of the bow becomes rapidly more difficult and may bend the limbs excessively.

FIGS. 2A-C illustrate the operation, not the construction, of a compound archery bow. As understood by those of skill in the art, many variations in construction can be made. For example, the pulleys need not be concentric or circular and radii 34 and 35 need not be collinear. Depending upon the adjustment to draw weight or draw length, e.g. by changing the length of the bowstring, radius 34 may not be opposite contact point 37 with the bow at rest or at point 39 at full draw. Despite these differences, the operation of other compound bows is approximately the same: during draw, the bowstring unwinds and the radius to the contact point increases; each cable wind more tightly and the radius to the contact point decreases near full draw.

In FIGS. 2A-C, both pulleys are viewed from the side of the string pulley, as though the string pulley were transparent. FIGS. 3-5 have a different orientation, showing both major surfaces of the wheel. FIG. 3 illustrates a string pulley from the string pulley side of the wheel. FIG. 5 illustrates a cable pulley from the cable side of the wheel, not through the string pulley as though the string pulley were transparent. FIG. 4 is a cross-section of the wheel showing the adjoining pulleys.

FIGS. 3-5 illustrate a wheel constructed in accordance with a preferred embodiment of the invention for a high performance wheel, i.e. a wheel in which both pulleys are cams. In FIGS. 3 and 4, string pulley 51 has rim 54 surrounding central recess 61. Groove 55 extends circumferentially around the perimeter of pulley 51 for receiving a bowstring. Rim 54 includes several channels, such as channels 65 and 67, extending from recess 61 to openings 63 in one side of groove 55.

Diameter 58 intersects hole 82 and is perpendicular to diameter 59, defining four quadrants. Apertures 71-74 reduce the mass of pulley 51 and are located in respective quadrants. Aperture 75 is also included in the upper portion of recess 61 to further reduce the mass of pulley 51. The remaining material in the hub of pulley 51 forms a web for supporting the rim and surrounding holes 81, 82, and 83. Rim 56 of pulley 52, shown in dotted line in FIG. 3, is attached to and supports the hub of pulley 51.

Diameter 59 intersects the centers of holes 81 and 83, on either side of diameter 58. Recess 61 does not include the region around holes 81 and 83 or the regions along diameter 59 between holes 81 and 83 and the nearby portions of rim 54. Wheel 50 turns on an axle through hole 83, as indicated by the plus sign. Thus, the full thickness of the hub rests on the axle, providing a strong connection and a large bearing surface. Hole 81 is a "tool hole" for holding wheel 50 in place during machining.

Hole 82 is approximately centrally located within pulley 51 positioned slightly below diameter 59 as shown in FIG. 3. Recess 61 surrounds hole 82 and is separated from the hole by a predetermined distance, e.g. 0.125 inches, forming wall 88. Although wall 88 could be left straight or cylindrical, it is preferred that the wall have at least a shallow, circumferential groove, shown in FIG. 4 as groove 89, for securely holding the loop of a bowstring. The outside diameter of wall 88 is preferably 0.375 inches or more, several times the thickness of a bowstring, in order to provide a large radius of curvature for the loop in the end of a bowstring to avoid strain in the loop as it encircles the post formed by wall 88.

A channel is formed through wall 88 by slots 91 and 92 to provide lateral access to hole 82. Recess 61 has a depth greater than the thickness of a bowstring and wall 88 is as high as recess 61 is deep. Notch 94 provides a passageway from one side of wheel 50 to the other. Slot 91 is connected to notch 94 by channel 93, which slopes at an angle to the plane of pulley 51, as shown in FIG. 4. This prevents any sharp bends or kinks which could weaken the lacing as it passes through the wheel. Slot 91 is preferably slightly deeper than slot 92, continuing the slope of channel 93. Hole 82 is threaded, as shown in FIG. 4, for engaging a setscrew (not shown) to hold a bowstring in slots 91 and 92. The thickness of wall 88, e.g. 0.125 inches, is sufficient for some material to be removed in threading the hole yet leave the wall strong enough to support a loop.

Pulley 51 is attached to a bow by an axle through hole 83. A bowstring (not shown in FIG. 3) contacts wheel 50 in the first (upper right) quadrant and wraps counterclockwise around pulley 51 and enters recess 61 through one of the channels, channel 65 for example. Since pulley 51 is not round, and depending upon which channel is chosen, the point of initial contact between the bowstring and the rim can vary, perhaps even occurring in the fourth (lower right) quadrant.

If the bowstring terminates in a loop, the loop is placed around the post formed by wall 88. If the lacing is to pass through notch 94 from the string side to the cable side of wheel 50, then the lacing extends from channel 65 through slot 92, slot 91, and channel 93 to notch 94. The lacing is secured in slots 91 and 92 by a setscrew in hole 82 (not shown in FIG. 3). As the setscrew is tightened, it deforms the bowstring slightly into hole 82. Thus, the post enables two types of connection for a bowstring.

FIG. 5 illustrates cable pulley 52 as seen from the cable side of wheel 50. Diameters 102 and 103 correspond to diameters 58 and 59, respectively. Hole 83 is on the left hand side of diameter 102 and hole 81 is on the right hand side of diameter 102.

Pulley 52 has recess 104 formed therein for reducing the mass of the pulley. Apertures 106–109 are located in the respective quadrants defined by diameters 102 and 103 and further reduce the mass of the wheel. On the cable side, wall 112 surrounds hole 101 and has a height equal to the depth of recess 104. Wall 112 includes circumferential groove 113 for receiving a loop at the end of a cable and slot 119 to provide lateral access to hole 101.

A cable (not shown) engages pulley 52 in the first (upper right) quadrant and extends counterclockwise part way around the pulley to channel 115 in rim 56. Although the cable is wrapped one quarter turn or less around pulley 52, the cable will not disengage from the pulley because the cable winds onto the pulley as the bow is drawn. Channel 115 includes a curved portion and a portion along diameter 102, terminating in notch 94.

If the cable were continuous with the bowstring, the cable would engage groove 116 of rim 56 in the first quadrant, extend part way around pulley 52 to channel 115, through channel 115 to notch 94, then through the notch to the string side of wheel 50. If the cable terminated in a ferrule, the cable would extend around pulley 52, through channel 115, and through slot 119 in wall 112. Hole 101 is a socket for the ferrule. If the cable were terminated in a loop, the cable is oriented as above and the loop is placed around wall 112. Thus, the post permits all three types of connection for a cable.

As shown in FIG. 4, hole 82 is threaded while hole 101 is not threaded and has a larger diameter than hole 82 on the string side of wheel 50. This permits a larger, stronger ferrule to be used than if the holes had the same diameter. Holes 82 and 101 are collinear to facilitate manufacturing, but need not be collinear.

Wheel 50 is preferably made by machining a disk of aluminum which had been extruded in a flat bar and cut to the approximate shape of the wheel. Other suitable materials are magnesium, alloys of aluminum or magnesium, plastics, and composites. Channel 115 is made by machining from the cable side of the wheel. Channel 93 and slots 91 and 92 are then completed by machining from the bowstring side of the wheel.

Pulley 51 and pulley 52, as illustrated in FIGS. 3 and 5, are the upper pulleys for a right handed bow. The lower pulleys for a right handed bow would be represented by a mirror image of FIGS. 3–5. For a left handed bow, the upper and lower wheels are reversed from those in a right handed bow, placing the bowstring to the right of the cables.

Wheel 50 is attached to an axle through hole 83. Since apertures 71–74 and 106–109 do not intersect either diameter, hole 83 is supported by a brace running along diameters 59 and 103. Similarly, since the cable and bowstring lie along diameter 58 or 102, the forces on the bowstring or cable are transmitted along braces running along diameters 58 and 102. Holes 82 and 101 do not weaken the structure because each hole is surrounded by a wall which strengthens the bracing and serves as a post for receiving a loop connector. The bracing of pulley 51 is further strengthened by the rim of pulley 52, as shown in FIG. 3.

Figure 6:
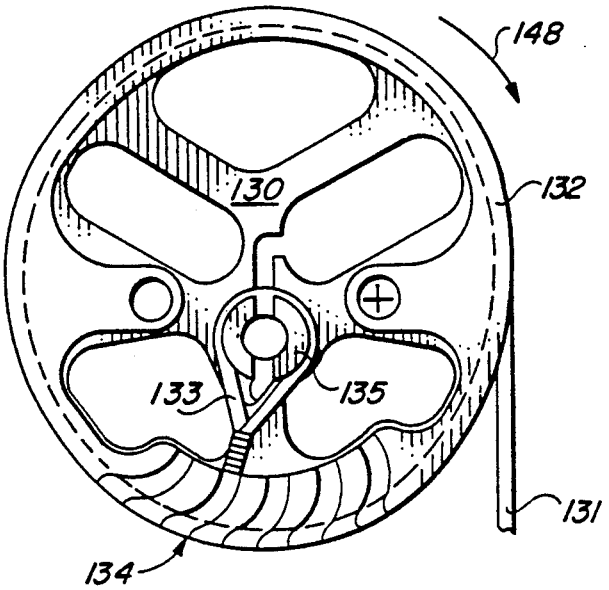
FIGS. 6 and 7 show how lacing with loop connectors is attached to the pulleys shown in FIGS. 3 and 5.
Figure 7:
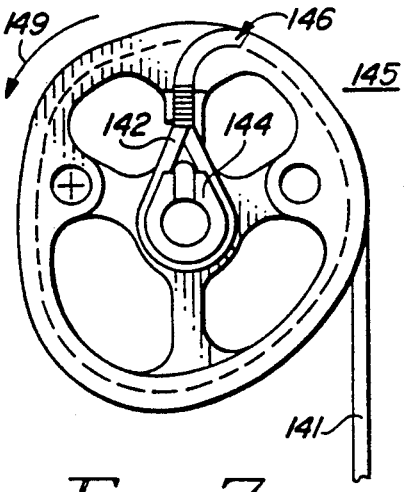

FIGS. 6–10 illustrate three of the combinations of connections which can be used with a wheel constructed in accordance with the present invention. In FIGS. 6 and 7, representing opposite sides of the same wheel, bowstring 131 engages groove 132 in the rim of wheel 130. The end of bowstring 131 terminates in loop 133 which surrounds post 135. Bowstring 131 enters the interior of pulley 130 through channel 134 in the rim. In FIG. 7, cable 141 engages groove 143 in the perimeter of pulley 145. Cable 141 terminates in loop 142 which surrounds post 144. Cable 141 enters the interior of pulley 145 through channel 146 in the rim of the pulley. Arrows 148 and 149 indicate the direction of rotation as the bow is drawn.

Figure 8:
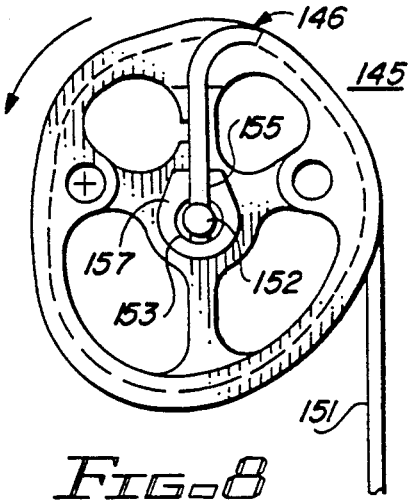
FIG. 8 shows how a cable with a ferrule connector is attached to the pulley shown in FIG. 5.

FIG. 8 shows an alternative connection to cable pulley 145 wherein cable 151 terminates with ferrule 152 in hole 153. Ferrule 152 is attached to the end of cable 151 which engages groove 143 and enters the recess of pulley 145 through channel 146 and slot 155 in wall 157.

Figure 9:
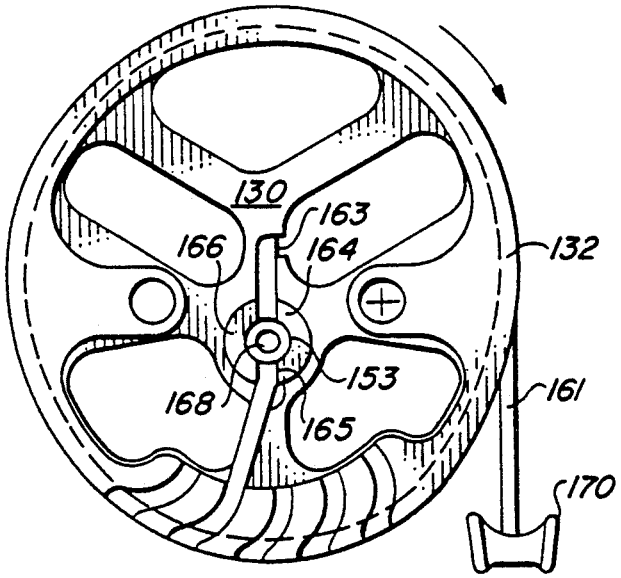
FIGS. 9 and 10 show how lacing with a teardrop connector is attached to the pulleys shown in FIGS. 3 and 5.

FIG. 9 illustrates the connection of either a one piece lacing or a cable terminating in a teardrop connector. Cable 161 emerges from the cable side of the wheel through notch 163 and passes through slots 164 and 165 in wall 166. Hole 153 is threaded and receives setscrew 168 for securely holding cable 161 in place in slots 164 and 165. Cable 161 emerges from slot 165 and passes through channel 134 to wrap partially around pulley 130. Cable 161 emerges from groove 132 and is terminated in teardrop connector 170. If cable 161 were part of a one piece lacing, the teardrop connector would be eliminated and cable 161 would cross the span between the wheels to engage the other wheel.

Figure 10:
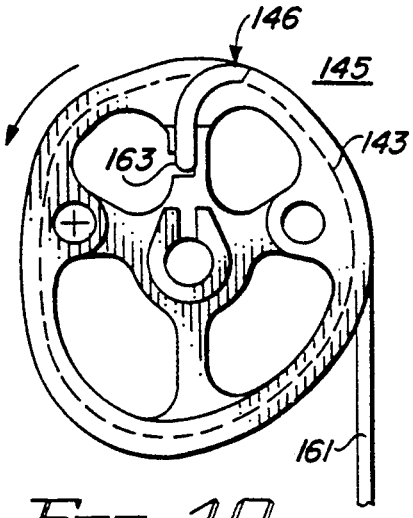

In FIG. 10, cable 161 engages groove 143 in the rim of cable pulley 145. Cable 161 passes through channel 146 to notch 163 for crossing through the wheel to the string side and continuing around, as described for FIG. 9.

A wheel constructed in accordance with the present invention can accommodate three types of connections in various combinations. The unique post on each side of the wheel provides this versatility for wheels of any performance level without weakening the wheel.

Having thus described the invention, it will be apparent to those of skill in the art that various modifications can be made within the scope of the invention. For example, the wall forming each post need not be circular but can extend along the slot, as in FIG. 5, to strengthen the slot and provide a larger surface for engaging the cable. Hole 101 can be threaded to match hole 82 and a bowstring clamped between setscrews inserted from opposite sides of the wheel. The dimensions noted are typical and not critical. The geometry of the pulleys may dictate that holes 82 and 101 not be collinear, or, if collinear, not centrally located. This is particularly true for cam pulleys which can have quite irregular shapes. Both posts can be three-way by inserting a ferrule into hole 82. Instead of securing cable 161 with setscrew 168, a ferrule can be attached to cable 161 for placement in hole 153. Alternatively, a single piece lacing can be used and held in place with either a ferrule or a setscrew.

We claim:

1. In a compound archery bow having a handle, first and second limbs each having a first end connected to said handle, an axle connected to a second end, and a wheel having a hub mounted on said axle, and lacing connecting said wheels with said first and second limbs, the improvement comprising:

a first post on one side of the hub of each wheel and a second post on the opposite side of the hub of each wheel, said first post including a first hole and said second post including a second hole collinear with said first hole and extending through said hub; and said lacing being attached to at least one of said posts on each wheel.

2. The compound archery bow as set forth in claim 1 wherein said first hole is threaded.

3. The compound archery bow as set forth in claim 2 wherein said second hole is larger in diameter than said first hole.

4. The compound archery bow as set forth in claim 1 wherein said first and second posts each include a circumferential groove.

5. The compound archery bow as set forth in claim 1 wherein said first and second posts each include a slot to provide lateral access to said first and second holes, respectively.

6. The compound archery bow as set forth in claim 1 wherein each wheel includes a pair of pulleys and a passageway through the hub of each wheel adjacent said first and second posts.

7. The compound archery bow as set forth in claim 6 wherein said hub of each wheel includes a channel interconnecting one of said slots and said passageway.

8. A compound archery bow comprising:

a handle;

first and second limbs each having a first end connected to said handle, an axle connected across the width of a second end, and a wheel mounted on and rotatable on said axle;

lacing for interconnecting said wheels;

each of said wheels including a pair of pulleys each having:

a rim including a circumferential groove, said lacing engaging said rim at a contact point and extending from said contact point part way around said pulley in said groove;

a first hole extending through both of said pulleys, said wheel being mounted with its respective axle through said first hole;

a first diameter of each pulley intersecting the center of said hole, said first diameter including the largest radius of each pulley as measured from said center;

a second diameter of each pulley perpendicular to said first diameter, at least a portion of said lacing lying along said second diameter;

a post located along said second diameter, said post including a second hole.

9. The compound archery bow as set forth in claim 8 wherein the second holes of the pulleys in each wheel are collinear.

10. The compound archery bow as set forth in claim 9 wherein at least one post of each wheel includes a slot for providing lateral access to said second hole.

11. The compound archery bow as set forth in claim 8 wherein the second hole of one pulley of each wheel is threaded.

12. A three way wheel for a compound archery bow comprising:

first and second adjoining pulleys having a common hole for engaging an axle and having first and second major surfaces;

a first diameter of each pulley intersecting the center of said common hole, said first diameter including the largest radius of each pulley as measured from said center;

a second diameter of each pulley perpendicular to said first diameter;

a recess of predetermined depth in respective major surfaces of said pulleys, said recesses not including said common hole;

a second hole parallel to said common hole located in said recess along said second diameter of each pulley; and a wall surrounding each second hole, said wall having a height approximately equal to said predetermined depth.

13. The wheel as set forth in claim 12 wherein said second holes are collinear and one of said second holes is threaded.

14. The wheel as set forth in claim 13 wherein the other of said second holes has a diameter larger than the diameter of said one of said second holes.

15. The wheel as set forth in claim 12 wherein each of said walls includes a circumferential groove.

16. The wheel as set forth in claim 12 wherein each wall includes a slot for providing lateral access to said second holes.

* * * * *